US006443794B2

(12) United States Patent
Oren et al.

(10) Patent No.: US 6,443,794 B2
(45) **Date of Patent: *Sep. 3, 2002**

(54) TOY

(75) Inventors: Shoshana Oren, Herzlia; Roni Golos; Zafrira Weisman-Sanger, both of Kiryat Ono, all of (IL)

(73) Assignee: Tiny Love Ltd., Tel Aviv (IL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 16 days.

(21) Appl. No.: 09/284,755

(22) PCT Filed: Aug. 18, 1998

(86) PCT No.: PCT/IL98/00390

§ 371 (c)(1),
(2), (4) Date: Jun. 9, 1999

(87) PCT Pub. No.: WO99/08765

PCT Pub. Date: Feb. 25, 1999

(30) Foreign Application Priority Data

Aug. 20, 1997 (IL) ..... 121584

(51) Int. Cl.[7] ..... A63H 33/04

(52) U.S. Cl. ..... 446/85; 446/227; 446/901; 5/420

(58) Field of Search ..... 446/85, 901, 227, 446/476, 73; 5/420, 417, 418, 419, 655; 482/23, 35

(56) References Cited

U.S. PATENT DOCUMENTS

| | | | | | |
|---|---|---|---|---|---|
| 1,829,963 | A | * | 11/1931 | Pettibone | 446/476 |
| 4,631,765 | A | * | 12/1986 | Casey | 5/417 |
| 4,754,512 | A | * | 7/1988 | Chao-Yang | 5/419 |
| 4,937,181 | A | * | 6/1990 | Rogers | 446/901 |
| 4,967,428 | A | * | 11/1990 | Browder | 5/419 |
| 4,978,301 | A | * | 12/1990 | Dodge | 446/901 |
| 5,069,623 | A | * | 12/1991 | Peat | 446/476 |
| 5,088,139 | A | * | 2/1992 | Bloom | 5/420 |
| 5,173,346 | A | * | 12/1992 | Middleton | 5/420 |
| 5,208,934 | A | * | 5/1993 | Backnick et al. | 446/73 |
| 5,212,842 | A | * | 5/1993 | Glydon | 5/420 |
| 5,330,379 | A | * | 7/1994 | Roh et al. | 446/901 |
| 5,360,653 | A | * | 11/1994 | Ackley | 5/420 |
| 5,546,620 | A | * | 8/1996 | Matthews | 5/655 |
| 5,707,269 | A | | 1/1998 | Murphy | |
| 5,722,446 | A | * | 3/1998 | Zheng | 446/476 |
| 5,947,786 | A | * | 9/1999 | Glick | 446/901 |
| 5,964,634 | A | * | 10/1999 | Chang | 446/901 |
| 5,970,541 | A | * | 10/1999 | Chiang | 5/420 |
| 6,079,067 | A | * | 6/2000 | Becker et al. | 5/655 |
| 6,082,386 | A | * | 7/2000 | Zheng | 482/35 |
| 6,199,230 | B1 | * | 3/2001 | Parikh | 5/420 |

FOREIGN PATENT DOCUMENTS

| | | | | |
|---|---|---|---|---|
| CA | 1324886 | | 5/1989 | |
| CA | 1324886 | | 12/1993 | |
| DE | 296 09 784 | | 9/1996 | |
| EP | 0 783 907 | | 7/1997 | |
| EP | 0783907 | A1 | 7/1997 | |
| GB | 2082925 | * | 3/1982 | 446/901 |

* cited by examiner

*Primary Examiner*—Derris H. Banks
*Assistant Examiner*—Urszula M Cegielnik
(74) *Attorney, Agent, or Firm*—Browdy and Neimark

(57) ABSTRACT

A planar toy element interchangeably attached to other planar toy elements to form an arrangement of elements which may define a planar or three-dimensional object. The planar element may be pliable or soft, may be soft or may have toy items attached thereto or integral therewith.

8 Claims, 6 Drawing Sheets

TOY

CROSS REFERENCE TO RELATED APPLICATION

The present application is the national stage under 35 U.S.C. 371 of PCT/IL98/00390, filed Aug. 18, 1998.

FIELD AND BACKGROUND OF THE INVENTION

The present invention relates to a toy and more particularly to a toy element which can be attached to other toy elements to form an arrangement of such elements. The present invention also relates to an assembly of two or more such elements.

There are many toys which are composed of elements which are joined together to form a two-or three-dimensional structure. In addition, there are also known toys which have various toy items attached thereto which are meant to provide a baby or a child with a variety of sensory stimuli, such as audio, visual, touch, etc. Such toy items are particularly designed so as to attract a child or baby to perform certain activities which assist in the child or baby's motor development.

GENERAL DESCRIPTION OF THE INVENTION

It is an object of the invention to provide a novel toy element attachable-to other toy elements to form a two- or three-dimensional structure. It is also an object of the invention to provide an assembly of such elements.

Other objects will become clear from the description below.

In accordance with one embodiment the invention provides a pliable, planar toy element interchangeably attachable to other planar toy elements at one or more sides thereof to form an arrangement of elements which, depending on manner of attachment, defines either a planar object or a three-dimensional object In accordance with another embodiment of the invention there is provided a planar toy element interchangeably attachable to other planar toy elements at one or more side thereof to form a planar object, being soft so as to allow a baby comfortably to lie, crawl or step thereon.

By yet a further embodiment of the invention there is provided a planar toy element interchangeably attachable to other planar toy elements at one or more sides thereof to form, depending on manner of attachment, a planar or a three-dimensional object, and having one or more toy items integral therewith or detachably attached thereto.

By yet another embodiment there is provided a soft planar toy element interchangeably attachable to other planar toy elements at one or more sides thereof, to form a planar path sufficiently large to allow a baby comfortably to lie, crawl or step thereon, the element having one or more toy items integral therewith or detachably attached thereto.

A planar toy element which is pliable or soft, is one preferred embodiment of the invention By one example, such element is constructed from a foamy substance coated by a non foamy material, e.g. a fabric. A pliable or soft toy element in accordance with the invention can be attached to other elements to either define a planar two-dimensional or three- dimensional object or structure. Furthermore, a soft element allows a baby or a child to comfortably step, sit or crawl thereon or on a planar structure formed by combining it with other elements.

The element in accordance with the invention, sized such so as to allow a baby to comfortably lie, crawl or step thereon is another preferred embodiment of the invention. Such an element may have a width of about 20–80 cm, typically of about 25–50 cm. Such an element, when attached to other such elements, can define a path for the baby to crawl thereon or therealong.

A toy element with toy items integral therewith or detachably attached thereto is another preferred embodiment of the invention.

The present invention also provides an assembly comprising at least two toy elements in accordance with the invention. One preferred embodiment of the invention is a toy assembly where the elements can be attached to form an annular-shaped object or are attachable to form a frustoconical hollow object.

The invention will now be illustrated by a description of some non-limiting specific embodiments with reference to the annexed drawings.

DESCRIPTION OF SPECIFIC EMBODIMENTS

Figure 1:
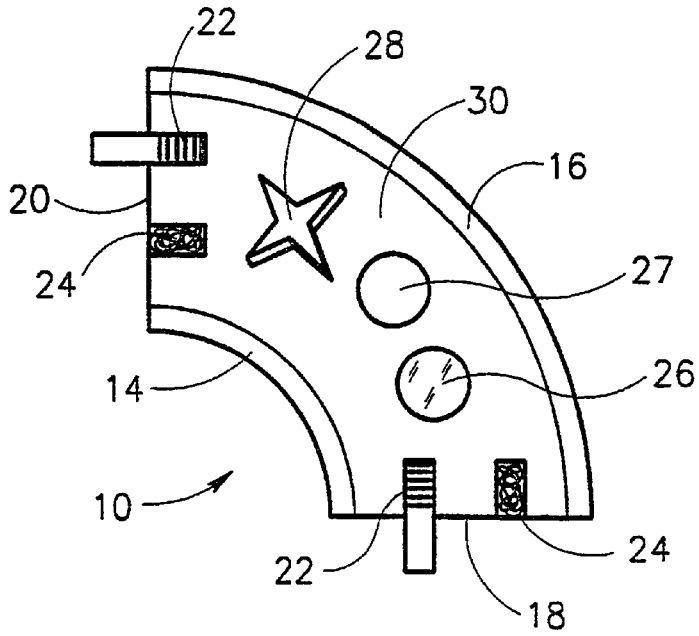
FIG. 1 shows a toy element in accordance with one embodiment of the invention.
Figure 2:
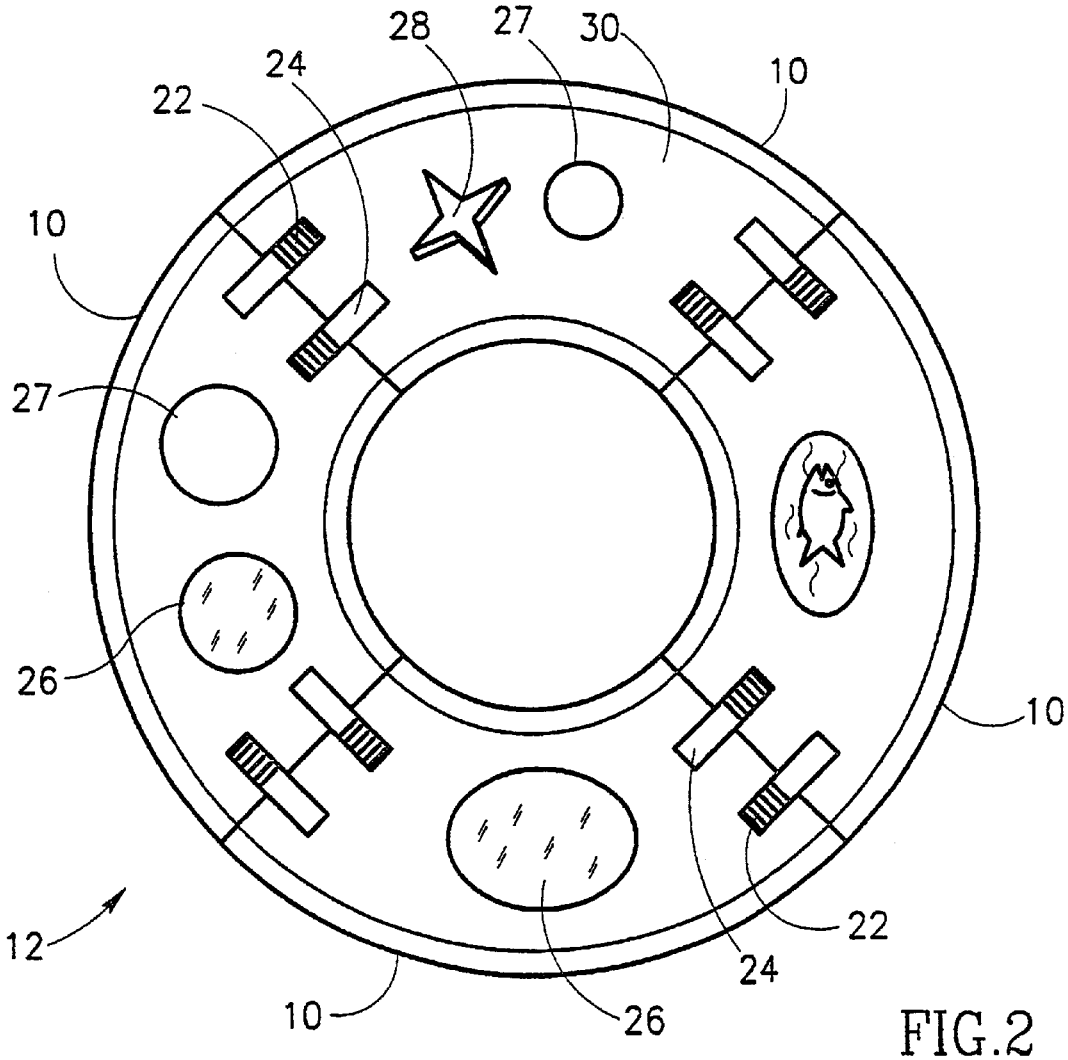
FIG. 2 shows an assembly of toy elements of the kind shown in FIG. 1 attached to form a planar ring-like structure.

FIG. 1 shows a planar element 10 in accordance with one embodiment of the invention, which has a shape defining a quadrant segment of an annular ring, and thus four such elements can be attached to form the ring 12 shown in FIG. 2. Element 10, typically made of a soft material such as a foamy material ensheathed by a non-foamy material, e.g. a cloth or another fabric. Element 10 has internal and external rims 14 and 16, respectively, which are sewn and stuffed in a manner to provide some structural rigidity. At times, rim 14 or 16 may incorporate a flexible core member, e.g. made of a deformable material such as metal or plastic wire or band, so as to allow reversible shaping of each of the elements into a three-dimensional form.

Side edges 18 and 20 of the element are provided each with attachment members 22 and 24, with member 22 being a hook member of a hook and pile attachment couple (e.g. Velcro™-type) and member 24 being a pile member of the hook and pile attachment couple. These attachment members 22 and 24 allow attachment of different elements one to another.

Element 10 is provided with a plurality of toy items, which may comprise elements integrally formed therein, e.g. a reflecting surface 26 sewn into the fabric, aperture 27, and a star FIG. 28, which may be a small stuffed figure, detachably attached to surface 30, e.g. by a hook member of the hook and pile attachment couple, provided at a bottom surface of element 28. In order to allow such form of attachment, surface 30 may be made of velvet, may be a suitable cotton cloth, may be made of tricot, etc.

Figure 3:
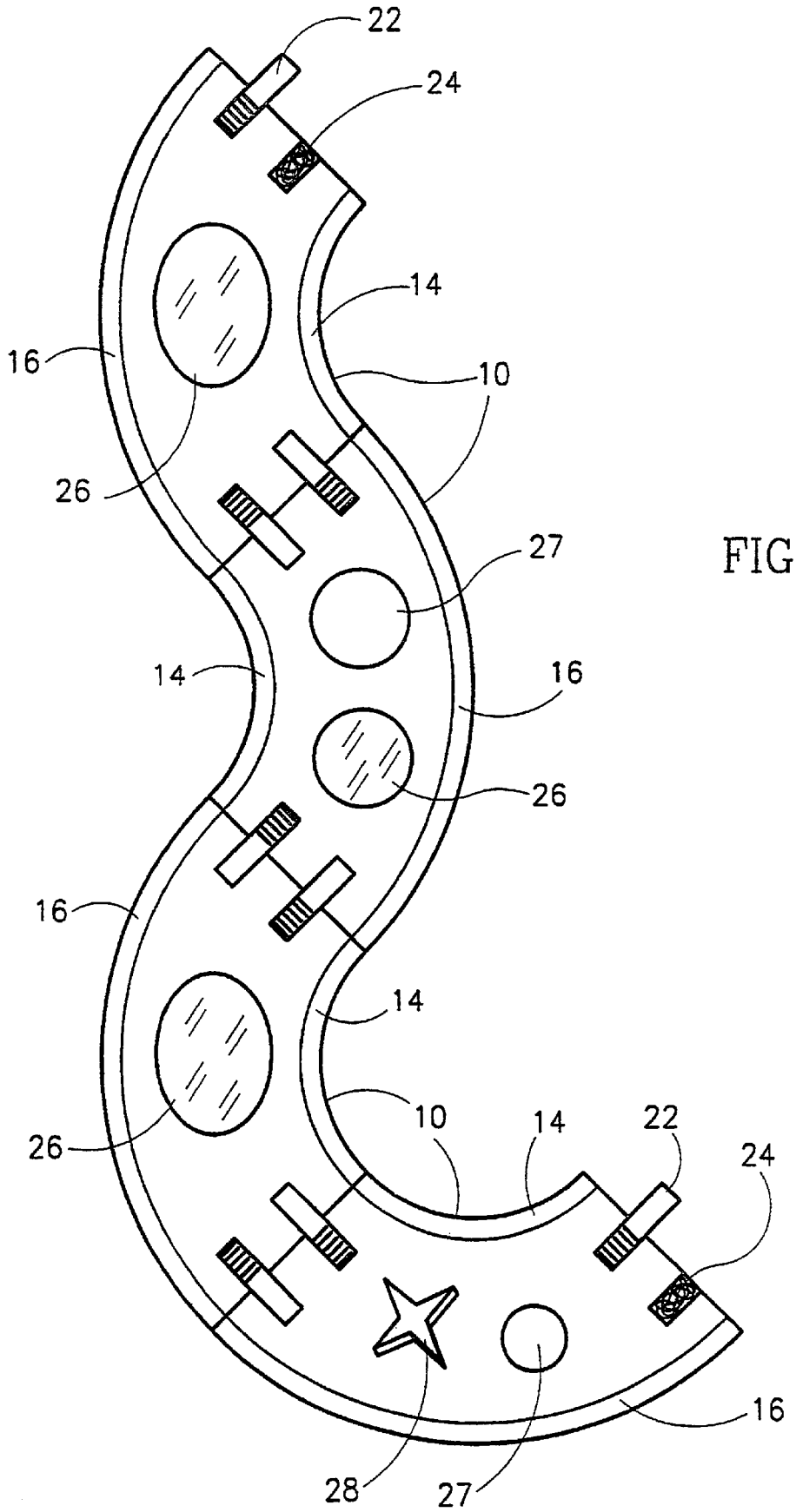
FIG. 3 shows an assembly of toy elements of the kind shown in FIG. 1 attached to form a planar tortuous linear path.

A plurality of elements 10 may be connected to form a torturous extensive, linear path, such as that shown in FIG. 3.

The various toy items on the toy elements are designed to provide sensory stimuli to babies. These may include items with different textured surfaces for different touch sensations; items of different colors; shiny or light generating objects to provide a visual stimuli; objects which generate sound; either as a result of pressure applied by them or as a result of touch-activated electrical sound generating mechanism; items which makes a cranky sound upon touching, or squeezing; a small liquid-filled enclosure with items floating therein; etc. In addition, surface 30 may be printed with various ornamental designs which may provide an accentuating background for the various toy items.

The configuration of the assembly shown in FIG. 2 is particularly suitable for a baby at an age in which he is still relatively stationary, before starting to crawl. The configuration of the assembly shown in FIG. 3 is particularly suitable for babies at an age where they begin to crawl, as the path formed by the elements encourages the baby to move along on the path to experience the various toy items provided along the path of elements 10.

Figure 4:
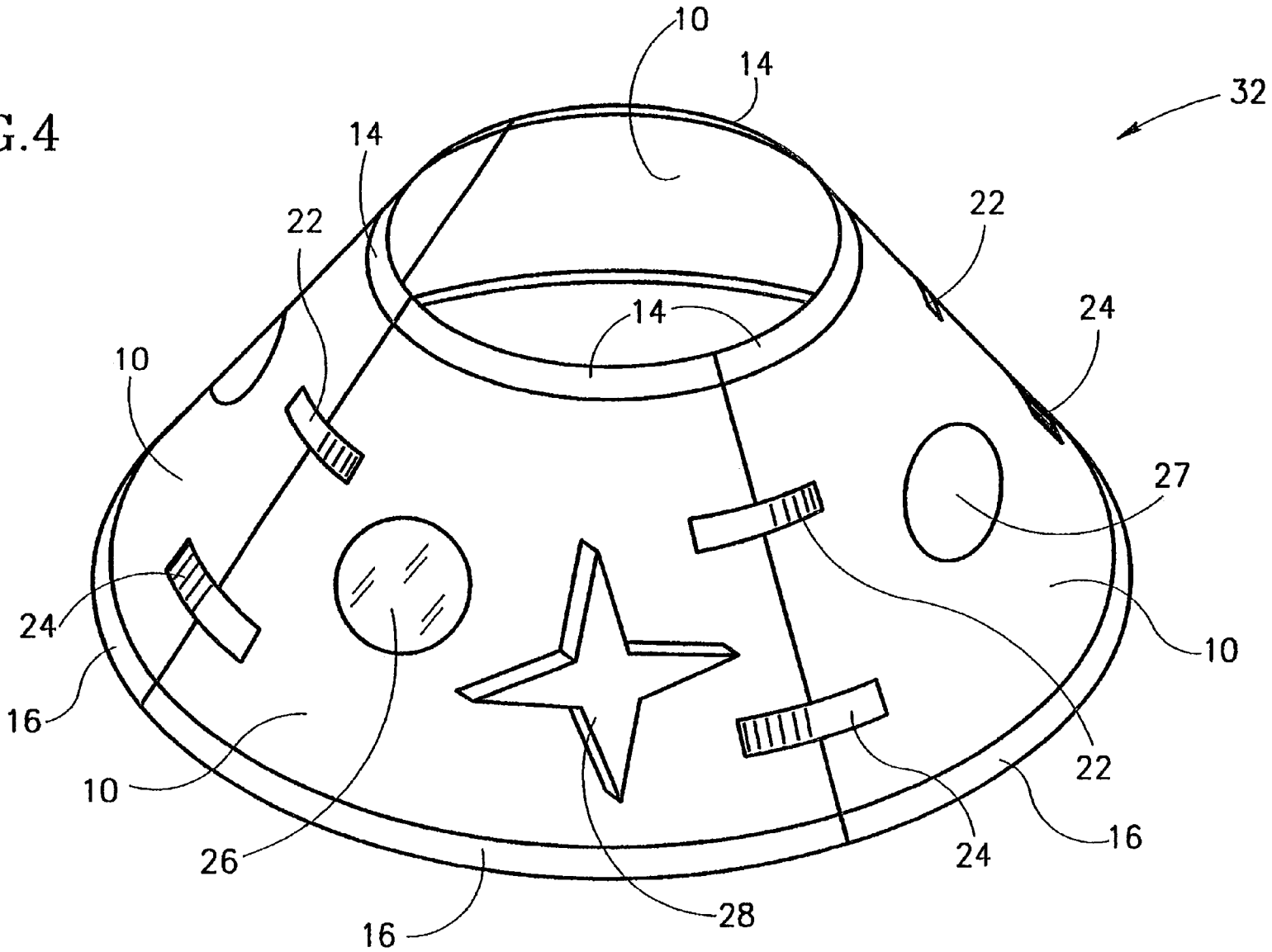
FIG. 4 shows a frustoconical object formed by three toy elements of the kind shown in FIG. 1 attached to one another.

FIG. 4 shows a different configuration of elements 10 formed into a frustoconical object 32. A frustoconical object may be formed from two or three such elements (structure shown in FIG. 3 is made of three such elements). This configuration of the assembly is typically suitable for children at an age where they can already sit and erect themselves, e.g. at an age above nine months.

Figure 5:
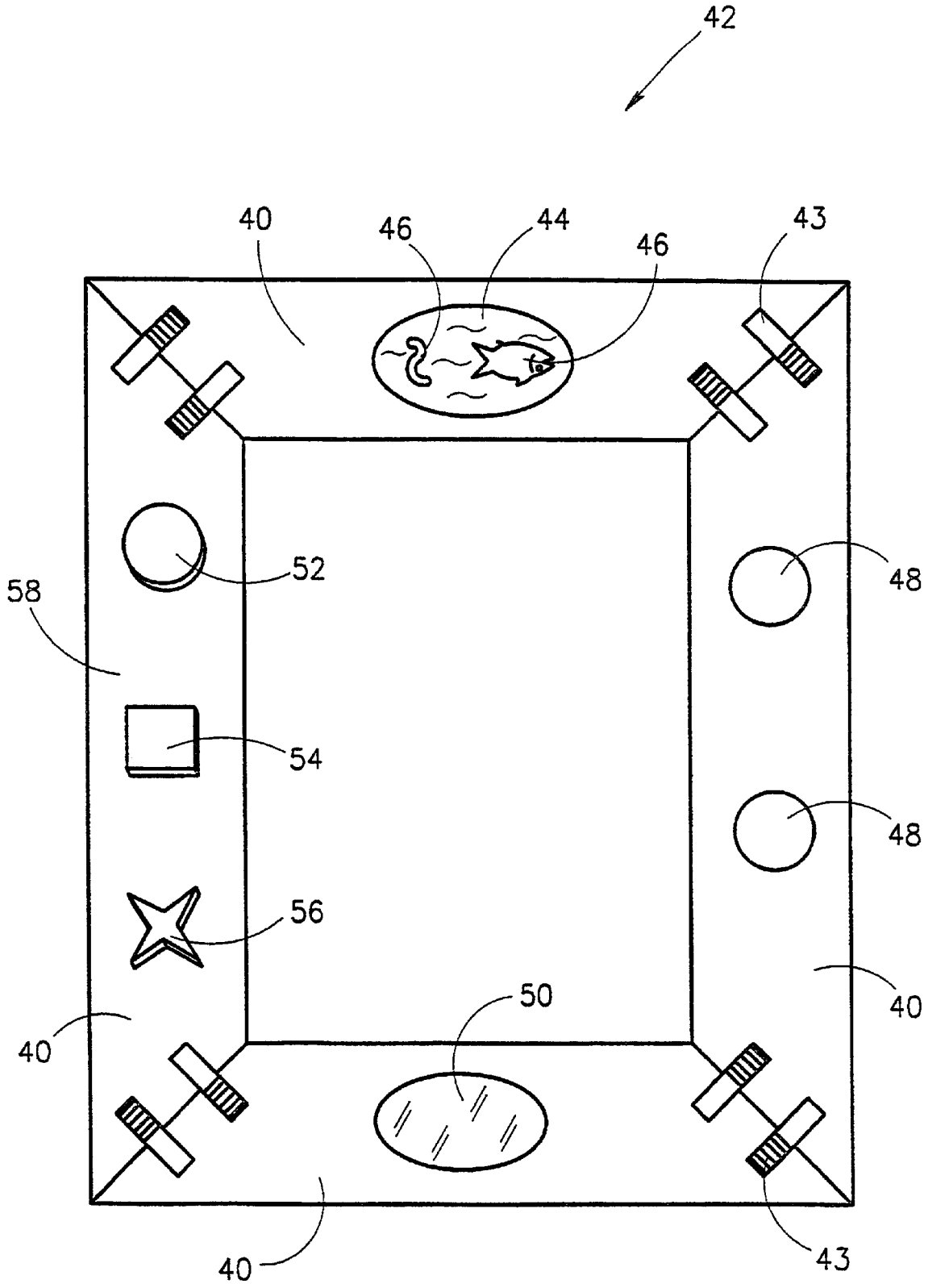
FIG. 5 shows an assembly of four planar elements in accordance with another embodiment of the invention attached to form a rectangular planar ring-shaped structure.

Elements 40 and a toy assembly 42 formed thereby, in accordance with another embodiment of the invention, can be seen in FIG. 5. In this case, each of elements 40 has a trapezoid shape and combines with other elements 40 of the assembly to form a ring-like shape with rectangular peripherals. The elements are attached to one another by hook and pile attachment members, similarly as the embodiment of FIGS. 14. Also similarly as in the embodiment of FIGS. 1–4, the different elements have toy items detachably attached thereto or integral therewith, such as a water- containing enclosure 44 with different elements 46 floating therein, openings 48, a reflective surface 50, or has fixed thereto detachable items such as stuffed FIGS. 52, 54 and 56.

Figure 6:
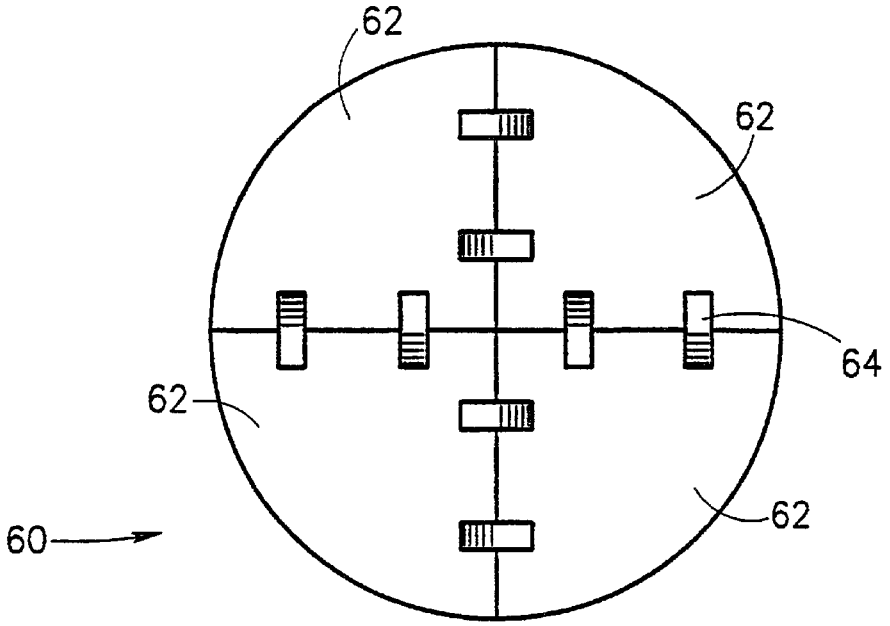
FIG. 6 shows an assembly comprising four elements in accordance with another embodiment of the invention, attached to form a circular-shaped planar objected.
Figure 7:
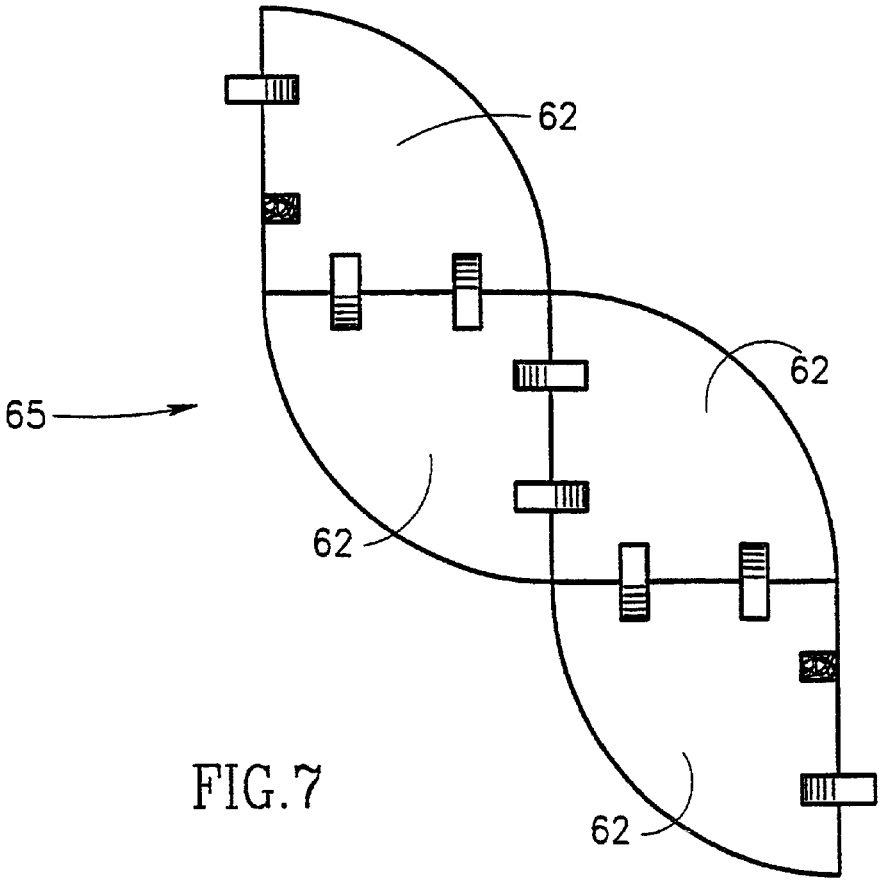
FIG. 7 shows the assembly of elements of FIG. 6 attached in a different way to form planar or tortuous shapes.

FIG. 6 shows a circle-like object 60 constructed from an assembly of four quadrant elements 62 attached together by hook and pile attachment members 64 in a similar manner to that shown in FIGS. 1–5. These elements may have a variety of toy items either integral therewith or detachably fixed thereto, similarly as described above. As can be seen in FIG. 7, the elements 62 may be connected to form a tortuous path 65.

Figure 8:
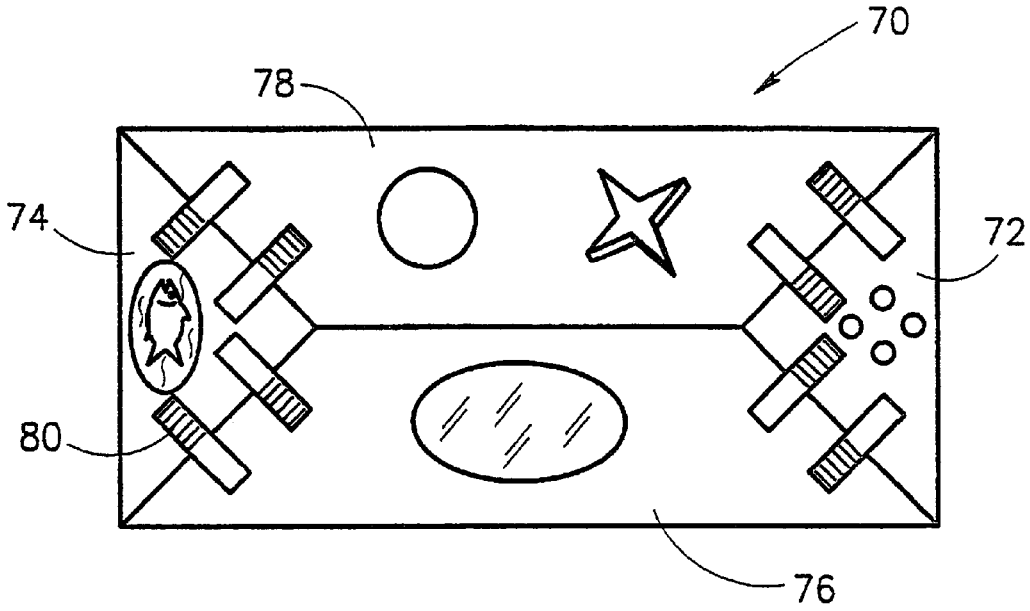
FIG. 8 shows an assembly of toy elements in accordance with another embodiment of the invention of two different shapes (two having a triangular shape and two a trapezoid shape) attached together to form a rectangular object.
Figure 9:
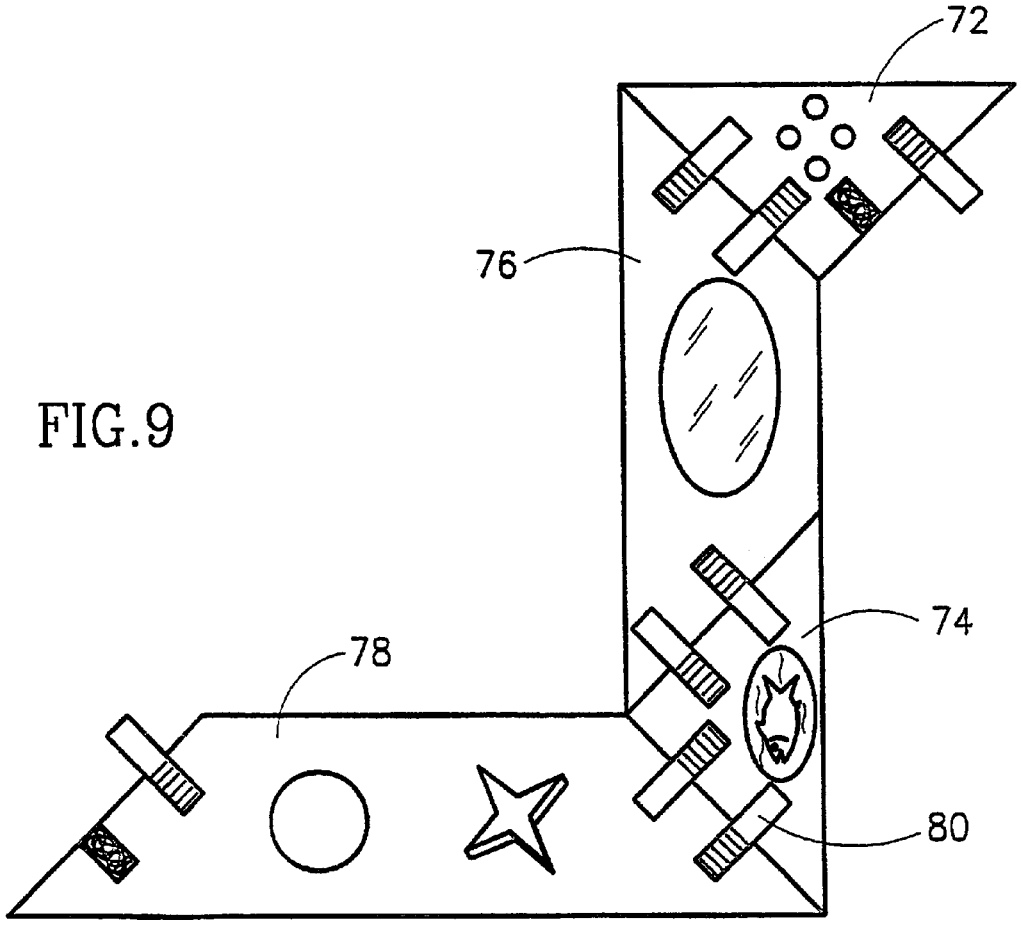
FIG. 9 shows the assembly of elements of FIG. 8 attached together to form a linear path.

In the embodiments shown in FIGS. 1–7, all the elements of the assembly were identical, but this does not necessarily need to be the case. An embodiment with elements of two different shapes is illustrated in FIGS. 8 and 9. The assembly 70 of this embodiment consists of two triangular elements 72 and 74 and two trapezoid elements 76 and 78, which may be interchangeably connected into a rectangular structure shown in FIG. 8. In an alternative configuration, they may be connected to form a linear broken path, such as that shown in FIG. 9. The manner of attachment of the elements to one another by means of attachment members 80 may be similar to that of the embodiment of FIGS. 1–7.

It should be noted that the manner of attachment of the elements of the invention to one another, may be different to that shown above. For example, the element may be connected by buttons and eyes attachment, by hook and eyes attachment, by snaps, buckles, etc. In addition, as will be appreciated, the order of different elements in the structures/objects formed by the plurality of attached elements can be changed.

Furthermore, the assemblies shown herein consist of four elements. It will be appreciated, that his is an example only and the assemblies may comprise different numbers of elements, e.g. 2, 3, 5, 6, and so on. Six elements, for example, may be combined to form hexagonal structure and a linear path-like structure based hereon; etc.

What is claimed is:

1. A play surface for a baby adapted to be placed onto a floor to form a path thereon, on which the baby may safely lie, crawl, or step, said play surface comprising:

A. a plurality of interfitting planar segments in the form of triangles, rectangles, or arcs of a circle in edge-to-edge abutting relation to define a relatively narrow continuous path suitable for a crawling baby having a configuration with an open space in the center along which the baby may travel;

B. detachable means interconnecting said interfitting planar segments to prevent their separation from each other to maintain said path; and C. decorative or play items attached to the path at spaced sites thereon to be encountered by the baby when traveling along the path whereby the baby will have an enjoyable experience.

2. The play surface according to claim 1 wherein said segments are formed of soft material.

3. The play surface according to claim 2 wherein said soft material is a flexible foam plastic.

4. The play surface according to claim 3 wherein said soft material is enclosed in a fabric casing.

5. The play surface according to claim 1 wherein the segments are interconnected by hook and plie attachment couplers.

6. The play surface according to claim 1 wherein the path has an annular configuration.

7. The play surface according to claim 1 wherein the path has a rectangular configuration.

8. The play surface according to claim 1 wherein the path has a sinuous configuration.

* * * * *